US009687061B2

(12) United States Patent
Klapia

(10) Patent No.: US 9,687,061 B2
(45) Date of Patent: Jun. 27, 2017

(54) COSMETIC APPLICATORS FOR APPLYING COSMETICS OF DIFFERENT COLORS

(71) Applicant: Jasmine Klapia, Encino, CA (US)

(72) Inventor: Jasmine Klapia, Encino, CA (US)

( * ) Notice: Subject to any disclaimer, the term of this patent is extended or adjusted under 35 U.S.C. 154(b) by 84 days.

(21) Appl. No.: 14/719,964

(22) Filed: May 22, 2015

(65) Prior Publication Data

US 2016/0338470 A1 Nov. 24, 2016

(51) Int. Cl.

| | |
|---|---|
| ***A45D 34/06*** | (2006.01) |
| ***A45D 40/24*** | (2006.01) |
| ***A45D 19/02*** | (2006.01) |
| ***A45D 29/00*** | (2006.01) |
| ***A45D 34/04*** | (2006.01) |
| ***A45D 40/26*** | (2006.01) |
| ***A45D 40/06*** | (2006.01) |
| ***A45D 40/20*** | (2006.01) |
| ***A45D 40/04*** | (2006.01) |
| *A45D 19/00* | (2006.01) |

(52) U.S. Cl.

CPC ..... *A45D 40/24* (2013.01); *A45D 19/02* (2013.01); *A45D 29/004* (2013.01); *A45D 34/045* (2013.01); *A45D 40/04* (2013.01); *A45D 40/06* (2013.01); *A45D 40/20* (2013.01); *A45D 40/205* (2013.01); *A45D 40/265* (2013.01); *A45D 34/06* (2013.01); *A45D 2019/0066* (2013.01); *A45D 2019/0091* (2013.01); *A45D 2019/025* (2013.01); *A45D 2040/207* (2013.01); *A45D 2040/208* (2013.01)

(58) Field of Classification Search

CPC ..... A45D 34/06; A45D 40/02; A45D 40/24
USPC ..... 401/16, 17, 18, 19, 21, 22, 25, 27, 29, 401/31, 32, 33, 34, 35
See application file for complete search history.

(56) References Cited

U.S. PATENT DOCUMENTS

| | | | | |
|---|---|---|---|---|
| 2,591,027 A * | 4/1952 | Turnes | A45D 40/06 | 401/19 |
| 6,895,628 B1 * | 5/2005 | Anderson | A45D 40/12 | 132/313 |
| 8,579,529 B2 * | 11/2013 | Pechko | A45D 40/02 | 401/17 |
| 2005/0072801 A1 * | 4/2005 | Chadfield | A45D 40/04 | 222/145.1 |
| 2009/0074500 A1 * | 3/2009 | Pires | A45D 40/24 | 401/31 |

* cited by examiner

*Primary Examiner* — David Walczak
*Assistant Examiner* — Joshua Wiljanen

(57) ABSTRACT

Cosmetic applicators for applying a cosmetic to a body part of a person are disclosed. The cosmetic applicators include containers in which cosmetics of different colors are respectively contained. The applicators are constructed so that the cosmetics can either be applied together or to be applied individually.

4 Claims, 20 Drawing Sheets

COSMETIC APPLICATORS FOR APPLYING COSMETICS OF DIFFERENT COLORS

BACKGROUND OF THE INVENTION

The present invention relates to cosmetic applicators and in-particular, to applicators for apply mascara to eyelashes, eye lids, eyebrows, lip liners, lipsticks and lip gloss, nail polish and hair color. The present invention also relates to cosmetic eye pencils and lip pencils.

The following discussion of related art is provided to assist the reader in understanding the advantages of the invention, and is not to be construed as an admission that this related art is prior art to this invention. In general, prior art applicators which apply mascara to eyelashes and eyebrows, eye pencil for the eye lid, lip liner, lipstick and lip gloss to lips, nail polish to nails and hair color all come in one color. These applicators however, are not able to apply two or more colors simultaneously. There is a significant need for such an invention.

SUMMARY OF THE INVENTION

According to one aspect of the present invention, a cosmetic applicator, includes a lower body having at least two separate containers each containing a cosmetic of a different color for application on eyelashes or eyebrows; a lid for closing said lower body; and brushes having one end provided with bristles and another end provided with a handle, wherein the brushes are detachably attached with the handle on the lid, and are received in the separate cavities in one to one correspondence when the lid closes the lower body.

According to another aspect of the present invention, a cosmetic applicator for applying a cosmetic to lips includes a housing; at least two applicator elements containing a cosmetic received in the housing; a main mechanism; and at least two auxiliary mechanisms, wherein the main mechanism and the at least two auxiliary mechanisms are connected to the at least two applicator elements, so that the at least two applicator elements are movable together out of and into the housing by actuating the main mechanism and are movable out of and into the housing independent of each other by actuating the at least two auxiliary mechanisms.

According to another advantageous feature of the invention, the at least two applicator elements include two lipsticks.

According to another advantageous feature of the invention, the at least two applicator elements include a lipstick and a lip liner.

According to another advantageous feature of the invention, the cosmetic applicator for applying a cosmetic to lips includes at least three of the applicator elements and at least three of the auxiliary mechanisms, wherein the at least three applicator elements include a lipstick, a lip liner and a lip gloss, each being individually movable in the housing by a respective one of the at least three auxiliary mechanisms, and are movable together by the main mechanism.

According to another advantageous feature of the invention, the cosmetic applicator for applying a cosmetic to lips, further includes a lip gloss applicator and a further auxiliary mechanism connected to the lip gloss applicator, wherein the lip gloss applicator is movable with the further auxiliary mechanism independent of the at least two lipsticks.

According to another aspect of the present invention, a cosmetic applicator, includes: a lower body including at least two separate containers detachably attached to each other, each container containing a cosmetic of a different color for application on nails; a lid for closing the lower body; and at least two applicator tools each having an applicator element on one end and a handle on another end, wherein the applicator tools is detachably attached to the lid with the handle, and received in the separate containers in one to one correspondence when the lid closes the lower body.

According to another aspect of the present invention, a cosmetic applicator includes at least two containers detachably attached to each other, said at least two containers each containing a cosmetic of a different color, and having an opening for application of the cosmetic on hair of a person; and a lower and an upper lid, said at least two containers being received in the upper lid, said openings being received in the lower lid.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
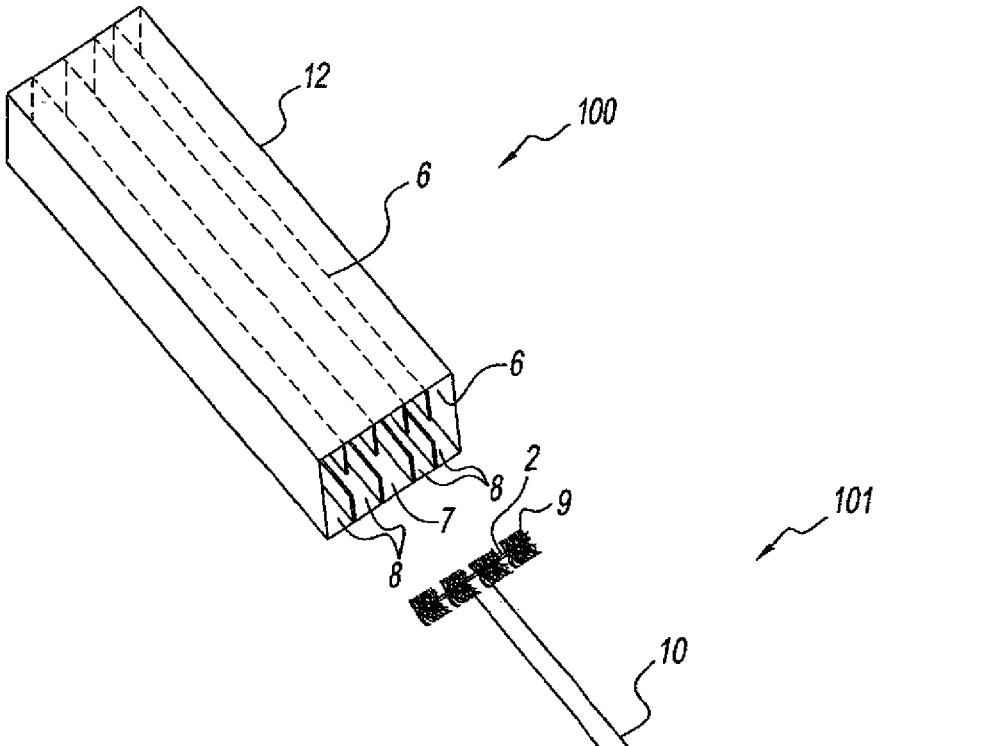
FIG. 1 is a perspective view of a cosmetic applicator according to the invention for application of multicolored mascara including a container and horizontal brush.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a cosmetic applicator according to the invention for applying mascara. The applicator includes a bottom portion 100 formed by container 12, and a separate brush 101. The container 12 has a rectangular shape, however other shapes of the container 12 are also conceivable. The interior 6 of the container 12 has four canals 8 that run through the interior 6 of the mascara container 12. The four canals 8 are filled with different tones and colors of mascara. The middle 7 is reserved for use as a channel through which the applicator brush can be inserted. The brush 101 has a handle 11, a stem 10 and a bristle portion 9 at its end 2. The bristle portion 9 is in a horizontal position, not vertical as with prior art brushes. When in use, the bristle portion 9 leaves different colors on eyelashes at the same time.

Figure 2:
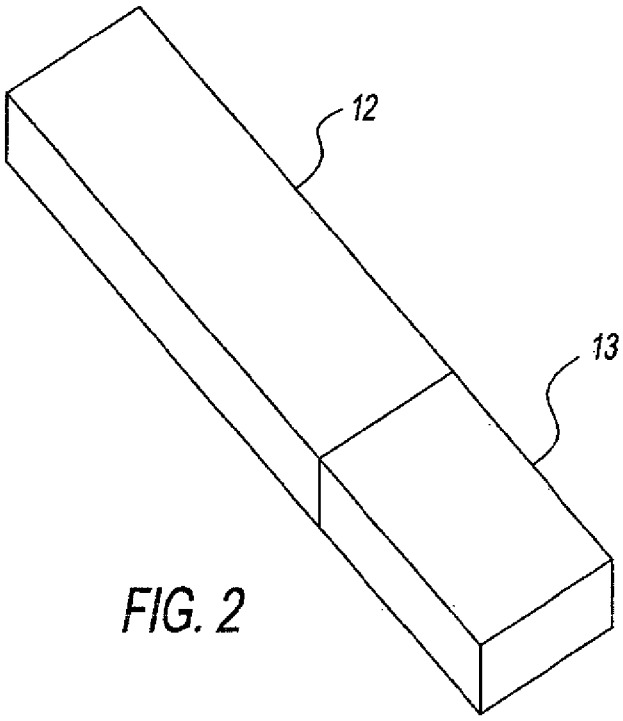
FIG. 2 is a perspective view of the cosmetic applicator of FIG. 1 with the horizontal brush received in the container and a cap closing the container.

FIG. 2 illustrates a fully packaged mascara applicator in which the horizontal brush 101 is received in the container 12. The fully packaged mascara applicator includes lid 13 covering the handle 11 of the brush 101 when the brush 101 is received in the container 12.

Figure 3:
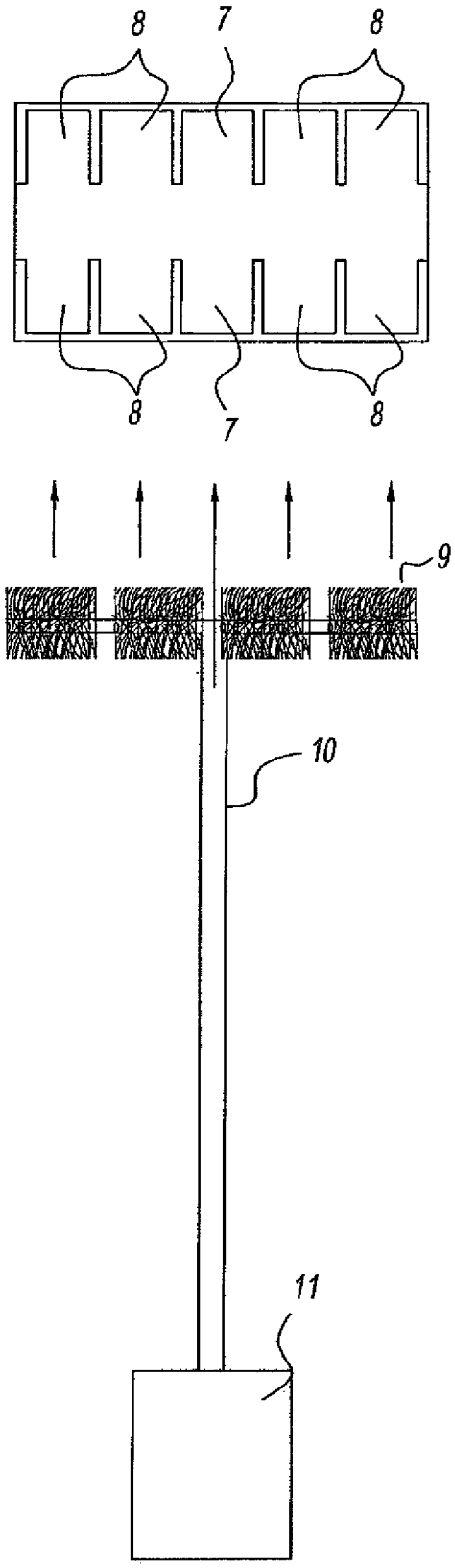
FIG. 3 is a top plan view onto the container of FIG. 1 and an enlarged view of the horizontal brush of FIG. 1.

FIG. 3 illustrates that the channels 8 are of equal size and shape in relation to the size and shape of the horizontal bristle portion 9 to ensure a perfect incision. When inserted, the entire length of the stem 10 of the bristle portion 9 can be inserted into the brush canal 7 through the use of the brush handle 11.

Figure 4:
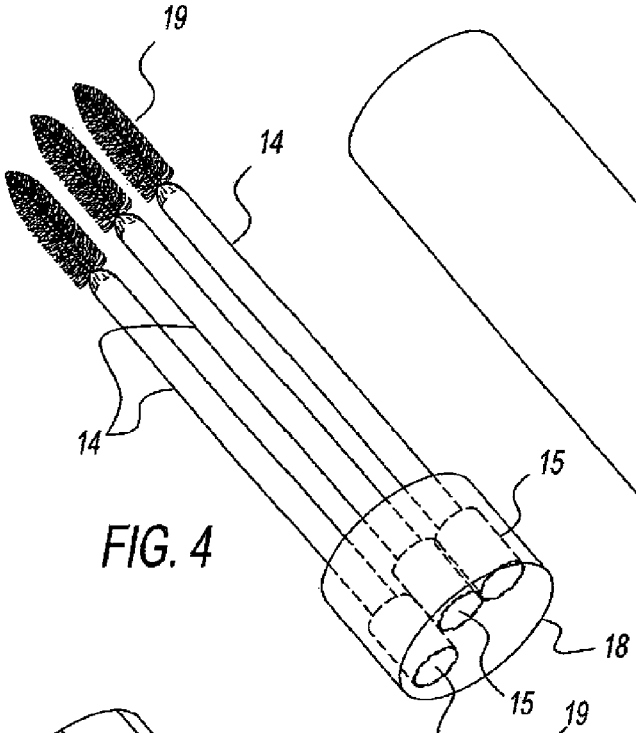
FIG. 4 is a perspective view of another embodiment of the cosmetic applicator for application of mascara with three detachable mascara brushes.

FIG. 4 shows another embodiment of the multi-color mascara applicator The brush 102 has a handle 15, a stem 14 and a bristle portion 19. In this embodiment the bristle portions 19 are oriented vertically. The brush 102 is detachably connected to the outer lid 18 via the handle 15. The container 17 has internal channels 20 for receiving the brush 102.

Figure 5:
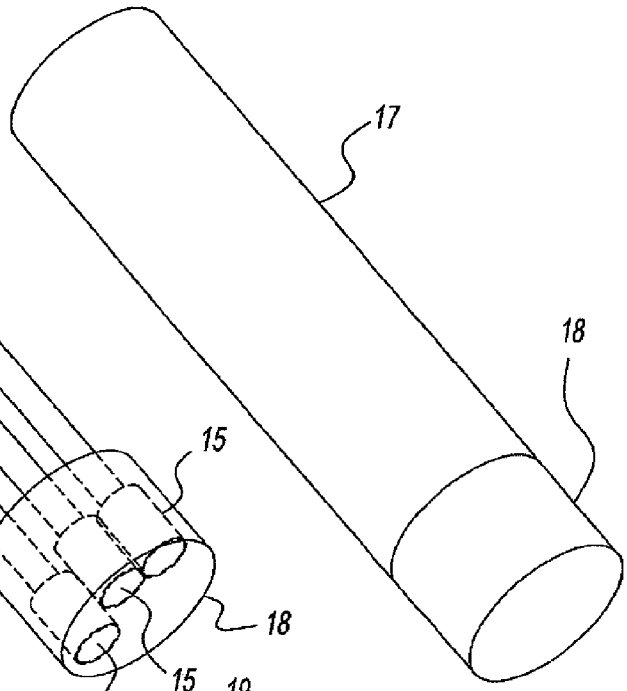
FIG. 5 is a perspective view of the embodiment of FIG. 4 with the mascara brushes received in a container and a lid closing the container.

FIG. 5 illustrates a fully assembled mascara applicator having a container 17 and a lid 18 with three detachable brushes enclosed in the container 17.

Figure 6:
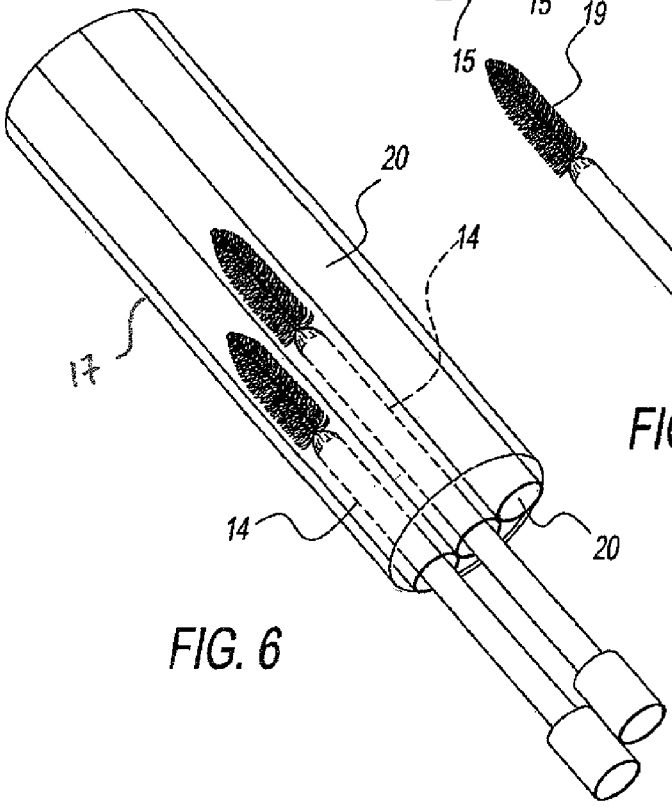
FIG. 6 is a perspective transparent view of the embodiment of FIG. 5 in which the container has three channels with two detachable brushes partially inserted therein.

FIG. 6 illustrates a transparent view of the three-channel mascara applicator with two detachable brushes 102 partially inserted into the channel 20.

Figure 7:
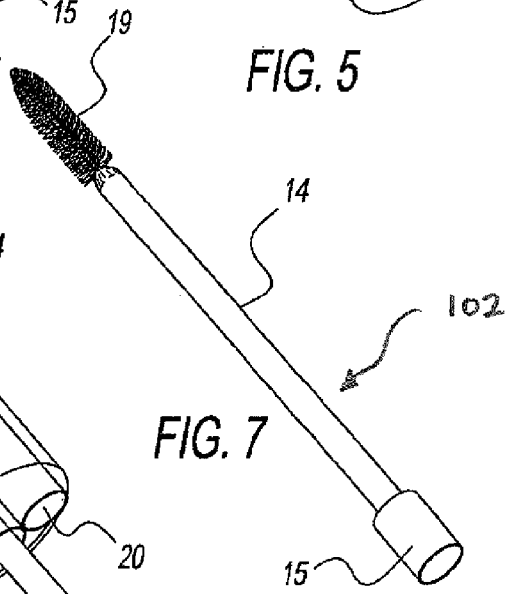
FIG. 7 is a perspective view of a single detachable brush of the embodiment of FIG. 4.

FIG. 7 shows a single detachable brush 102 with stem 14, handle 15 and vertical bristle portion 19.

Figure 8:
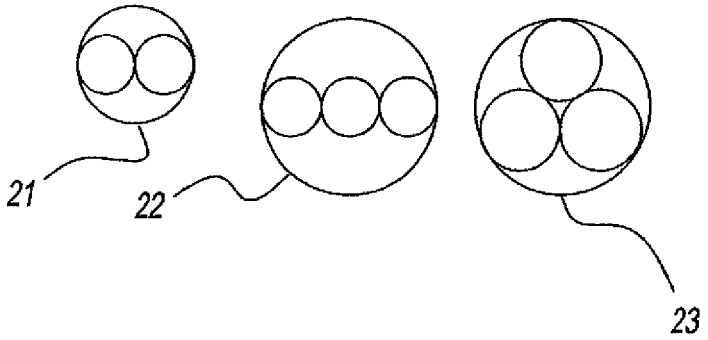
FIG. 8 is a bottom view of the container of the cosmetic applicator for application of mascara according to the invention showing different channel arrangements.

FIG. 8 illustrates that the mascara applicator for the vertical bristle configuration can come in many different shapes and layouts for the channels. As shown in the drawing, it can include two channels as shown in the embodiment of the container 21, or three channels as shown in the embodiment of the container 22. The channels can be arranged in different ways inside the container. For example the channels can be arranged so that their center points form the corners of a triangle as show in the embodiment of the container 23. It should be understood that the invention is not limited to just the three configurations illustrated and the container may also contain more than three channels in different configurations.

Figure 9:
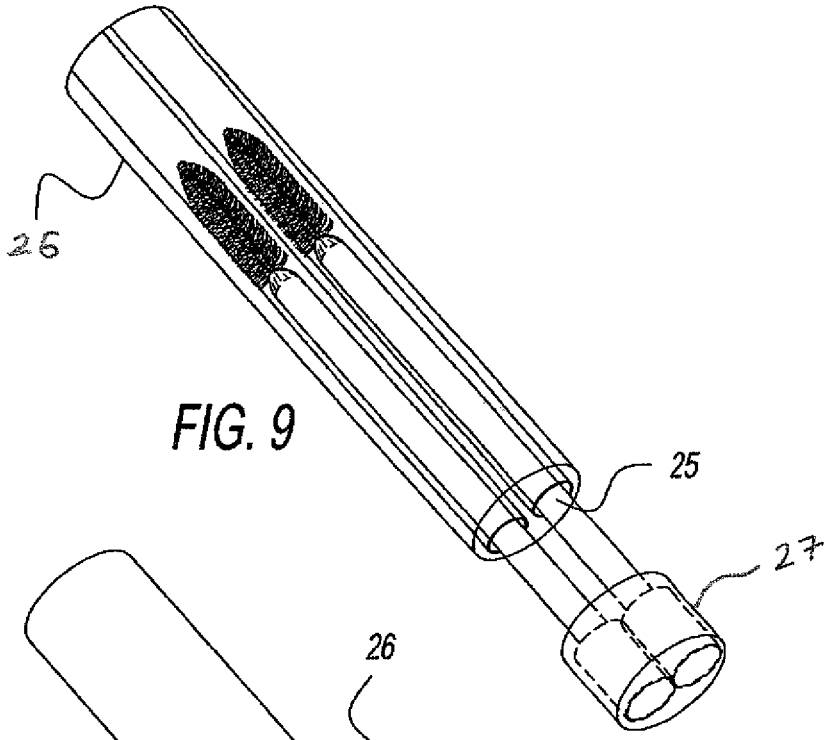
FIG. 9 is a perspective transparent view of the mascara applicator according to the invention with a container having two-channels with two detachable brushes partially inserted therein.
Figure 10:
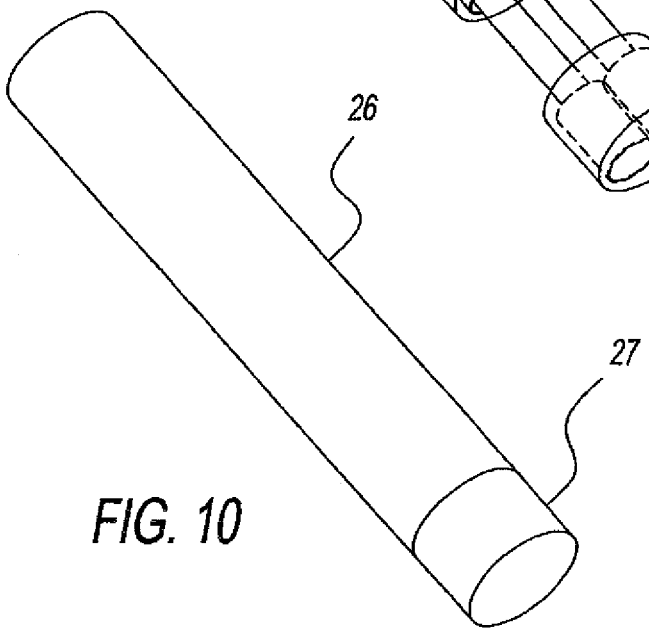
FIG. 10 is a perspective view of the embodiment of FIG. 9 with the brushes inserted in the channels and a lid closing the container.

FIG. 9 shows a mascara applicator with two brushes having the vertical bristle configuration. The brushes are partially received in the channels 25 of the container 24. FIG. 10 shows the mascara applicator of FIG. 9 in a fully assembled state with the lid 27 closing the container 26.

Figure 11:
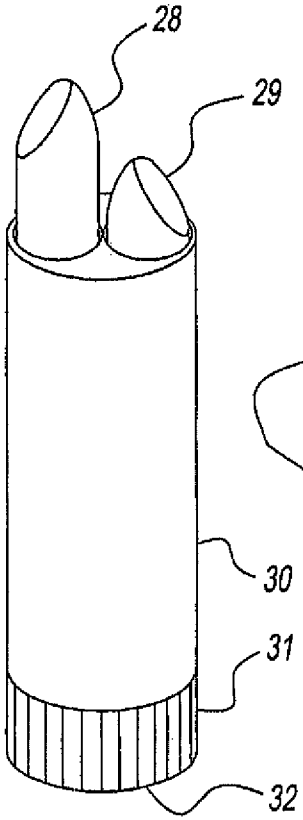
FIG. 11 is a perspective view of a double lipstick applicator according to the invention showing the main mechanism.

FIG. 11 illustrates a cosmetic applicator for applying a cosmetic to lips which includes two applicator elements configured as lipsticks of two different colors 28 and 29. It gives the user the ability to carry a single lipstick applicator 30 consisting of two separate lipsticks with two different colors 28 and 29. The applicator 30 is equipped with a main lifting and lowering mechanism 31 and auxiliary mechanisms 32 that enables the user to alternate between the applications of the two colors.

Figure 12:
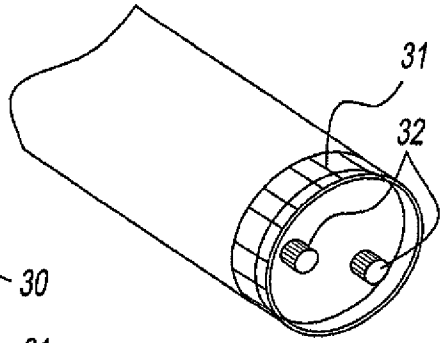
FIG. 12 is a bottom perspective view of a the lipstick applicator of FIG. 11 showing the main mechanism and the two auxiliary mechanisms.

As shown in FIG. 12, there is a main turning mechanism 31 and two auxiliary mechanisms 32. The main mechanism 31 is used to simultaneously lift both colors 28 and 29 while the two auxiliary lifting mechanisms 32 will each lift a single color at a time. All lifting mechanisms can either lift the desired color in the upper position or the lower position for storage.

Figure 14:
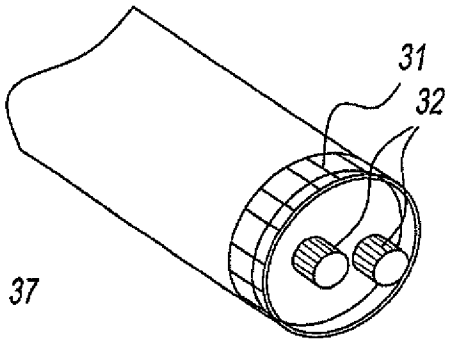
FIG. 14 is a bottom perspective view of the lipstick applicator of FIG. 13 showing the main mechanism and 2 auxiliary mechanisms.
Figure 13:
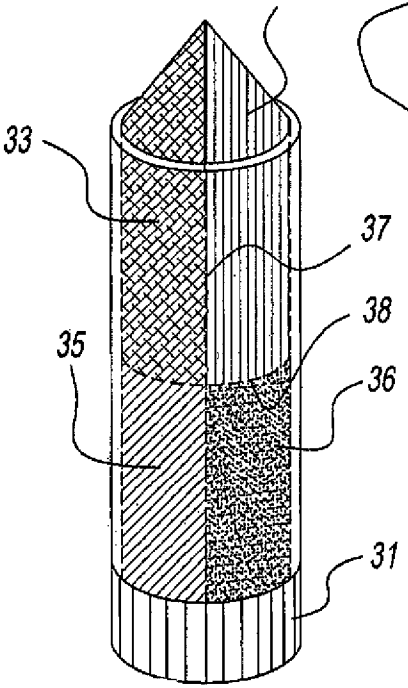
FIG. 13 is a transparent schematic view of the lipstick applicator according to the invention with 4 lipstick colors stacked in pairs of two.

FIG. 13 shows a lipstick applicator with four colors 33, 34, 35 and 36. The colors of the lipstick are stacked in pairs of two as 34 and 36 on one side, while 33 and 35 are on the other side. In this embodiment, the user can only use the top two colors 33 and 34 together or each of the top two colors at a different time, thus the user can choose to use color 34 or color 33 only. When the top two colors are used in full, the bottom two colors 35 and 36 will be visible for use. This gives the user the opportunity to a new set of colors without the need for buying a new lipstick. Each stack of color can be lifted or lower through the use of the lifting or screwing mechanism 31 and 32 shown in FIG. 14 and as described in FIG. 12. Line 38 in FIG. 13 indicates the border between the colors 33, 34 and the colors 35, 36.

Figure 16:
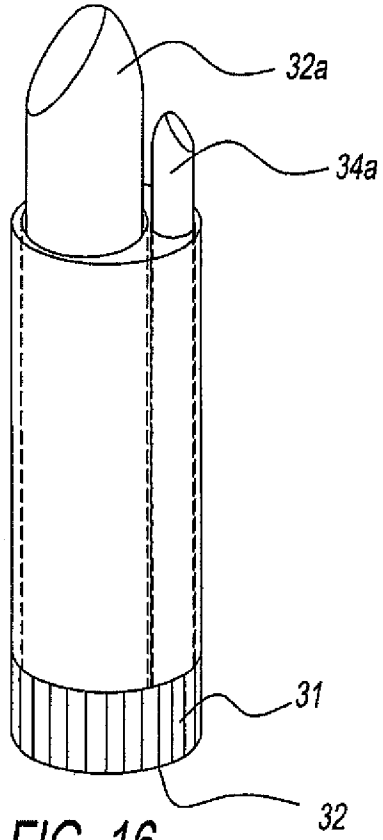
FIG. 16 is a perspective transparent view of a two in one lipstick applicator including a separate lip liner and lipstick.
Figure 15:
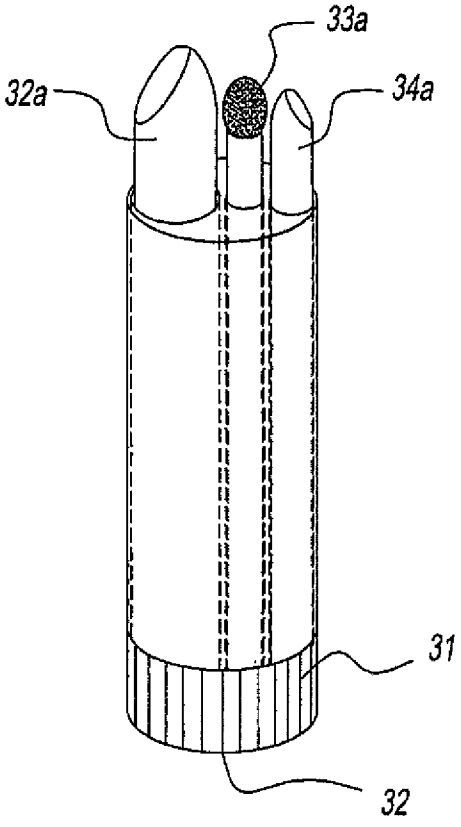
FIG. 15 is a perspective transparent view of a three in one applicator including a separate lip liner, lipstick and lip gloss.

FIG. 15 illustrates a three-in-one applicator including a separate lip liner 34*a*, lipstick 32*a* and lip gloss 33*a*, while FIG. 16 shows a two-in-one applicator including lipstick 32*a* and lip liner 34*a*. The purpose is to have a multiplicity of lip accessories in a simple package as one and for use separately, which is beneficial for daily use. Again, the lip liner 34*a*, lipstick 32*a* and lip gloss 33*a* can each be lifted or lowered individually or together through the use of the lifting or screwing mechanism 31 and or 32.

Figure 17:
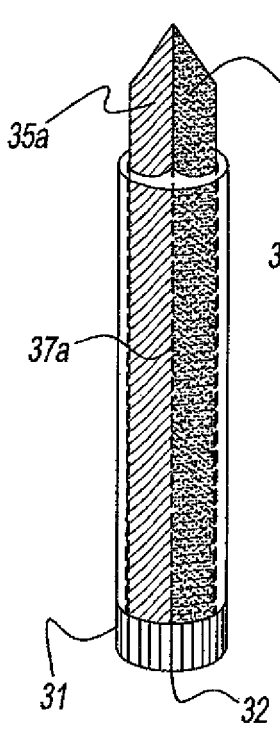
FIG. 17 is a schematic cutaway view of a two-color double lip liner applicator.
Figure 18:
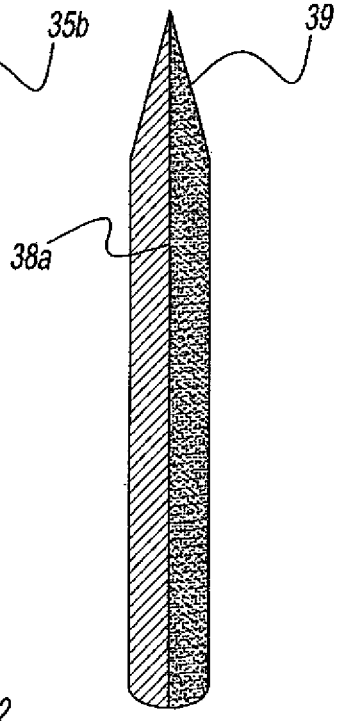
FIG. 18 is a schematic view of a two-color eye and lip pencil.

FIGS. 17 and 18 illustrate two color double lip liner 35*a* and 35*b*, and the two color eye and lip pencil 39. As shown in FIG. 17, the lip liner can work alternately through the use of the lifting mechanism 31 and 32, where a single color can be lifted or lowered at a time using lifting mechanism 32, or both can be lifted or lowered together using lifting mechanism 31. The two colors are attached to one another at 37*a*. When both colors are lifted together, both can be used simultaneously. Referring to FIG. 18, the double colors eye or lip pencil 39 comes as a single applicator where the colors are attached to one another at 38*a* without the need for a lifting mechanism.

Figure 19:
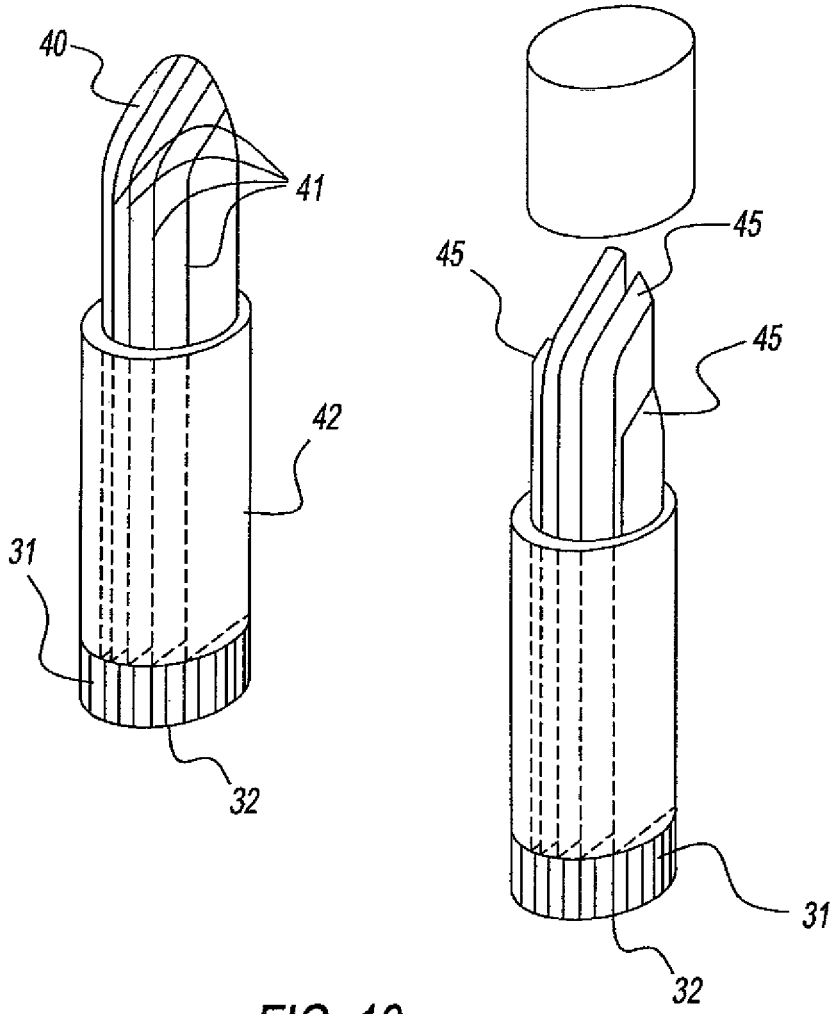
FIG. 19 is a perspective view of a multi-color lipstick applicator.

FIG. 19 shows an embodiment a the lipstick according to the invention with multiple lipstick colors 41. The colors are received in a housing 42 and can be used individually as respective single colors 45 or the colors 41 can be used together to form a single lipstick 40 for different application combinations and directions over the lips, i.e., horizontal, vertical, sideways, single lines, double lines, etc. The shape of a single line on the multicolor/purpose lipstick may vary in order to leave beautiful traces behind on a lip.

Figure 20:
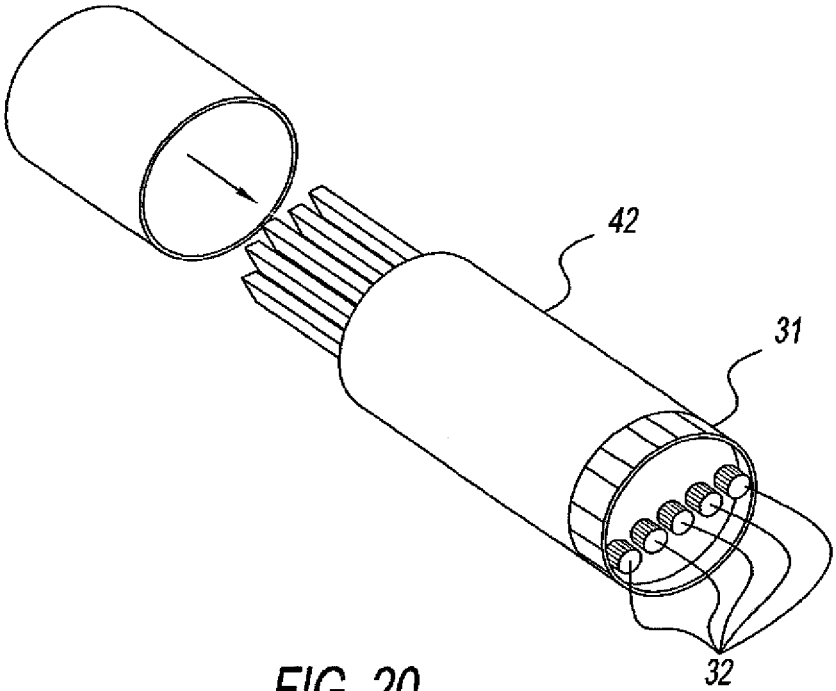
FIG. 20 is a is a bottom perspective view of the multi-color lipstick applicator of FIG. 19 showing the main mechanism and five auxiliary mechanisms.

For all the variations of two or more different colored lipsticks, the lipstick applicator includes a main mechanism 31 and an auxiliary mechanism 32 as shown in FIG. 20, where only one single color is moved for application or any selected subgroup of colors by turning an appropriate subset of the auxiliary mechanisms 32, or all colors can be moved together for application to the lips by turning the main mechanism 31. In FIG. 19 and FIG. 20, all colors are lifted at the same time. In between each separate color there can be a separate plastic wall.

Figure 21:
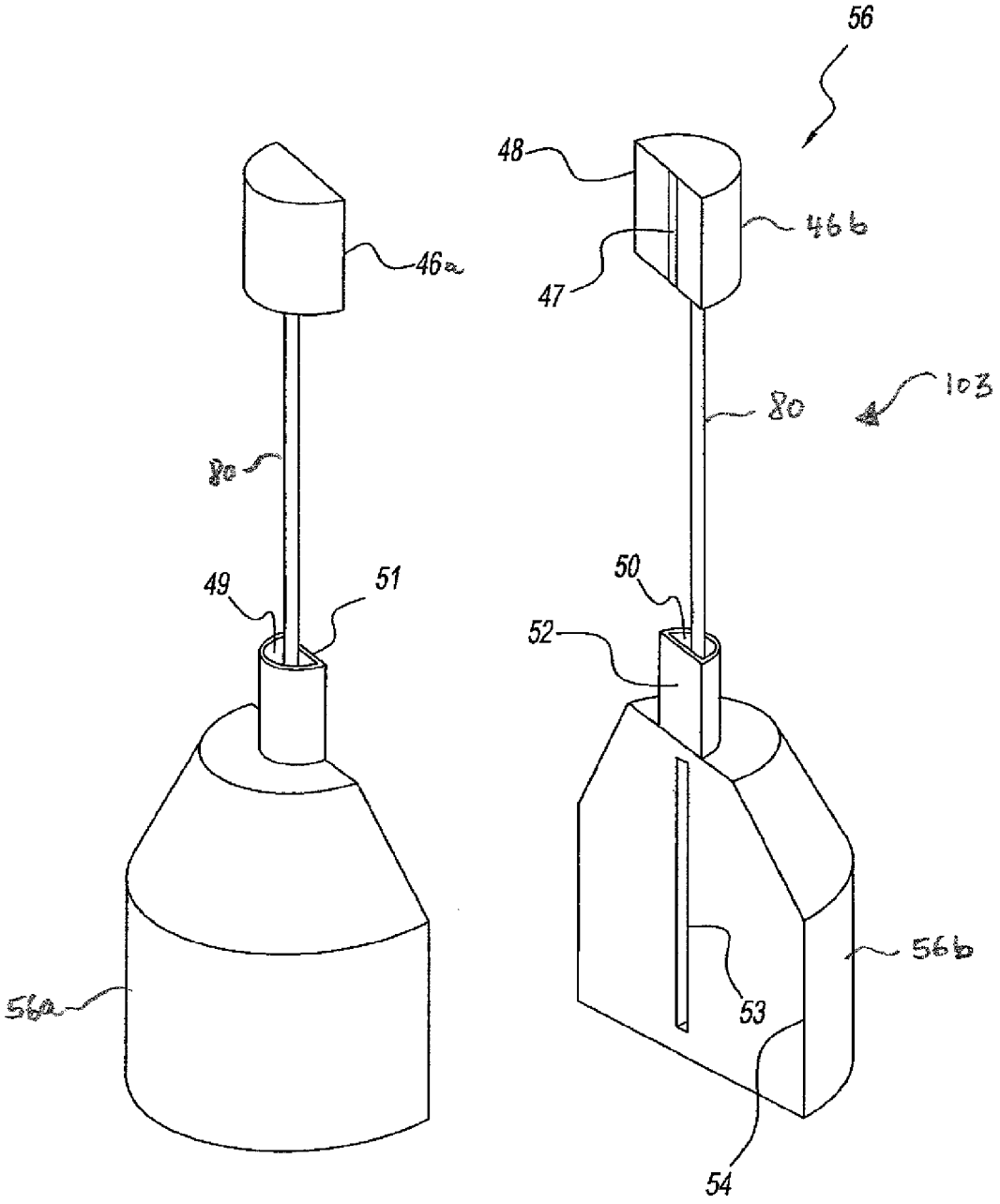
FIG. 21 is a perspective view of a nail polish applicator according to the invention showing separate detachably attachable containers and separate detachably attachable brushes.
Figure 22:
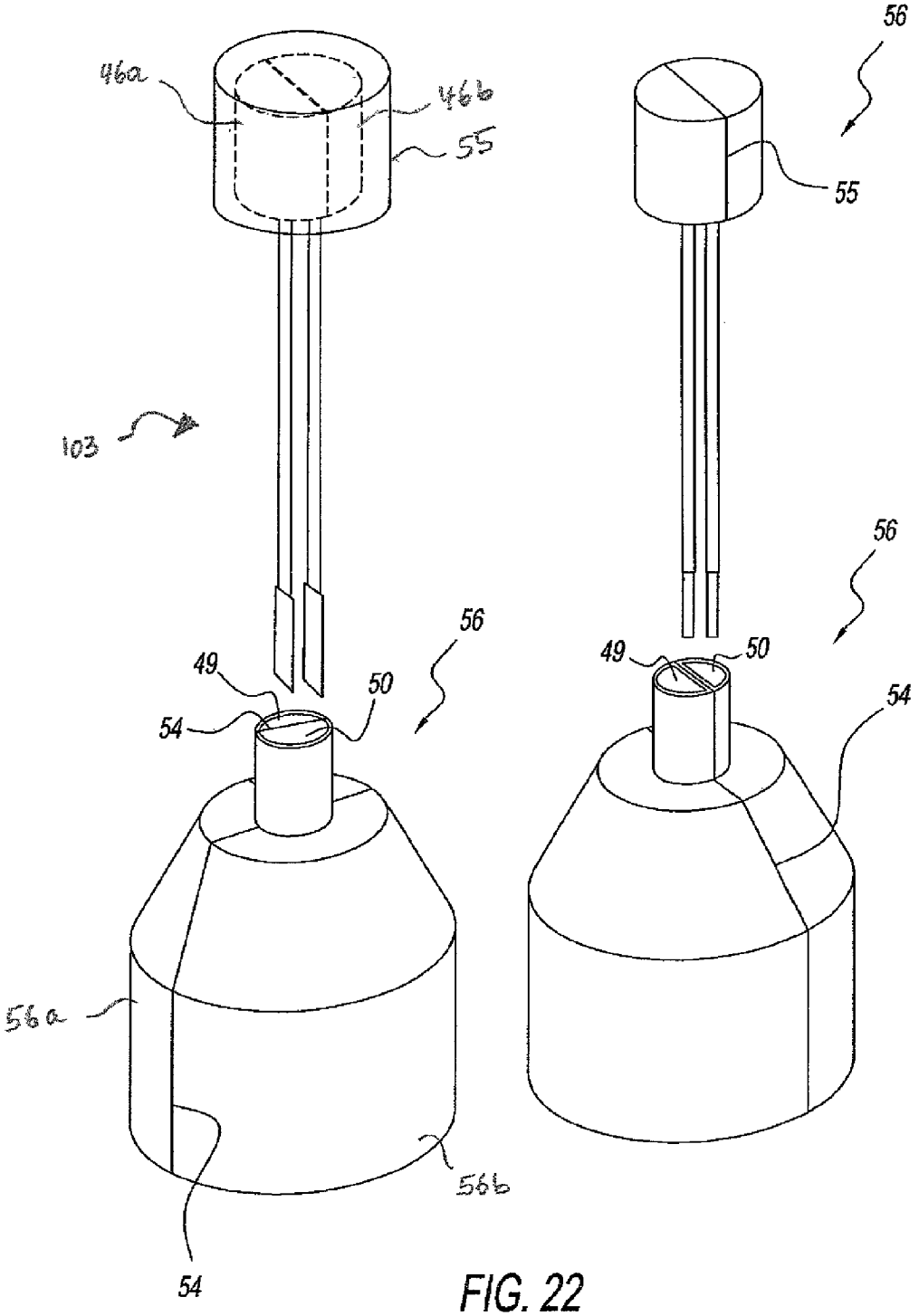
FIG. 22 is a perspective view of the nail polish applicator of FIG. 21 showing the containers and the brushes attached to each other.
Figure 23:
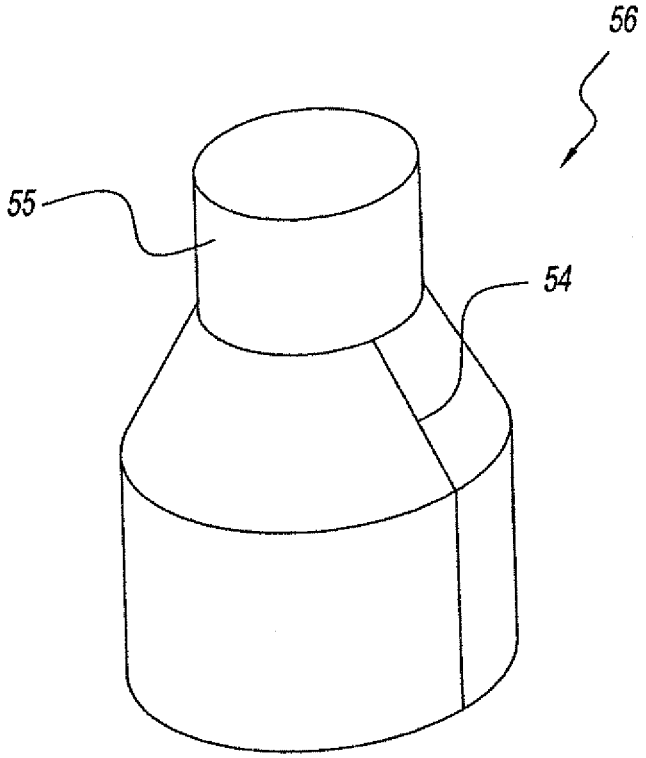
FIG. 23 is a perspective view of the nail polish applicator of FIGS. 21 and 22 in which the brushes are received in the containers and the containers are closed by a lid.

FIGS. 21, 22, and 23 illustrate a cosmetic applicator according to the invention for applying nail polish. The applicator includes a lower body 56 which is formed by two separate containers 56*a*, 56*b*, containing different colors of nail polish. Each container 56, has a neck portion 51, 52 and an opening 49, 50. The containers 56*a*, 56*b*, are detachably attached to each other via a snap mechanism 53 provided on a surface 54. The cosmetic applicator illustrated in FIGS. 22-23 also includes two applicator tools 103 each having a handle 46*a*, 46*b*, a stem 80 and a brush 60. The handle 46*a*, 46*b* also has a snap mechanism 47 with which the handles 46*a*, 46*b* can be detachably attached to each other. FIG. 21 shows that the lower body can be separated into two equal halves constituting the containers 56*a*, 56*b*. The two openings 49 and 50 form a double opening for application of each color. FIG. 22 shows the cosmetic applicator for application of nail polish in which the containers 56*a*, 56*b* are attached to each other. FIG. 22 also shows the applicator tools 103 attached to each other via the snap mechanism in the handle 46. When attached to each other the applicator tools thus form one applicator tool and can be used together as one. Optimally the applicator tools 103 can also be detached from each other to apply nail polish of different colors for example to different nails. FIG. 23 shows a fully assembled cosmetic applicator for nail polish in which the two containers 56*a*, 56*b* are attached to each other. A cap 55 closes the two containers 56*a*, 56*b*. A person can carry a single half of the applicator (including one container 56*a*, 56*b* and one applicator tool 103) or the applicator fully assembled.

Figure 24:
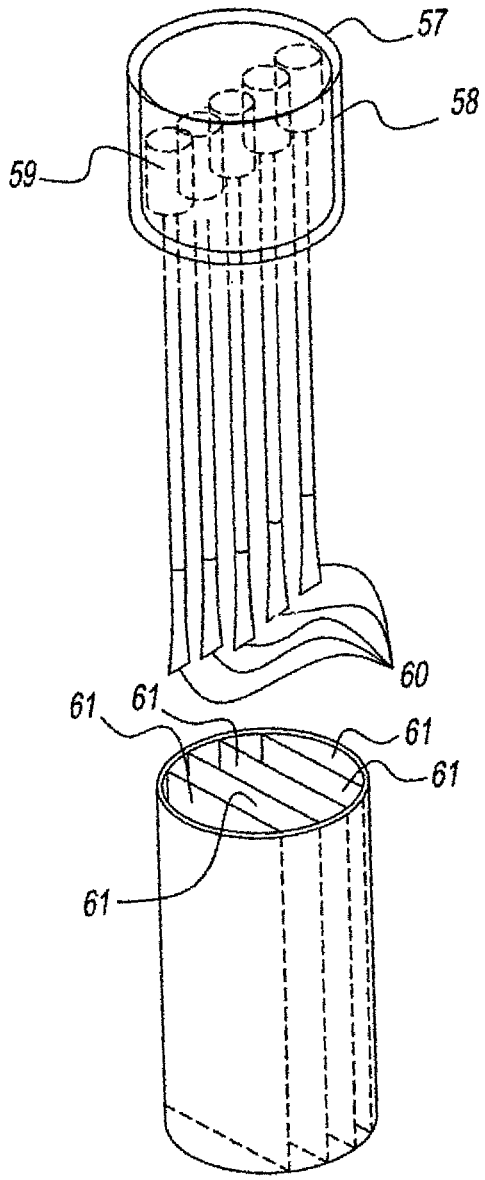
FIG. 24 is a perspective view of another embodiment of a multi-color detachable nail polish applicator according to the invention.
Figure 25:
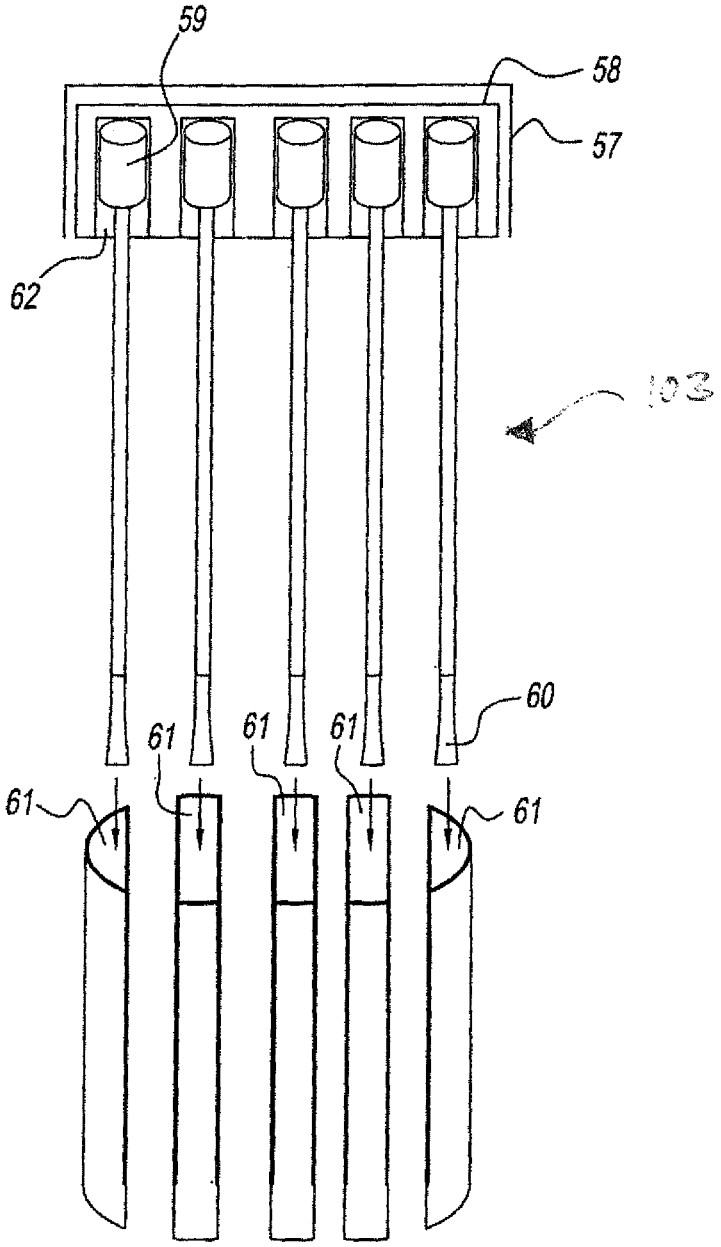
FIG. 25 is an exploded perspective view of another embodiment of the multi-color detachable nail polish applicator according to the invention.

FIGS. 24 and 25 illustrate an applicator for application of nail polish with a multiplicity of separate nail polish color chambers 61 and applicator tools 103 each having a stem a handle 59 and a brush 60 which correspond with the separate colors. In this embodiment the applicator tools are held individually in a slot 62 of the lid 57 via the handles 59. The chambers 61 can be separated from one another as shown in FIG. 25 via a snap mechanism, not shown. Also as shown in FIG. 25, each applicator tool 103 can be detached from the slot 62 and used individually.

Figure 26:
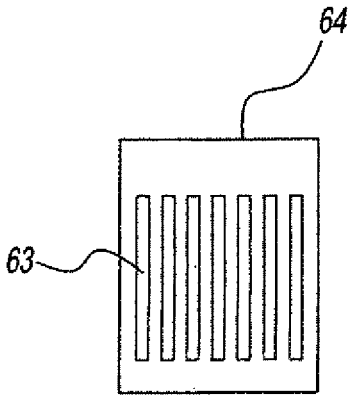
FIG. 26 is a self-adhesive paper with cutout shape used as a guide to apply straight lines and other decorative shades to nails.
Figure 27:
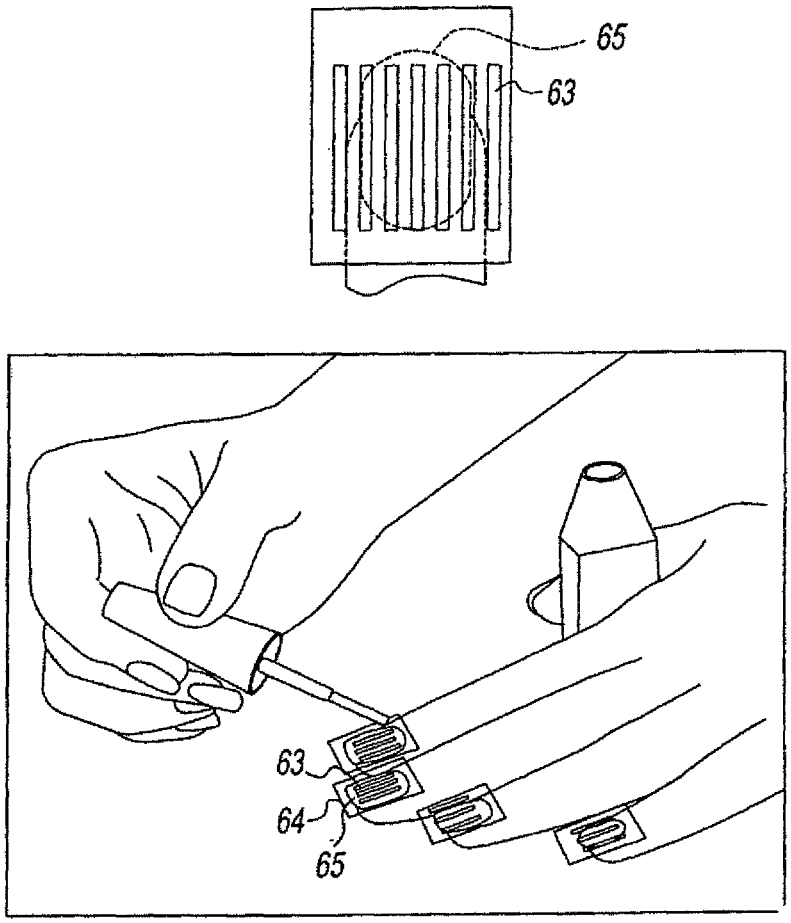
FIG. 27 is an example showing use of the self adhesive paper.
Figure 28:
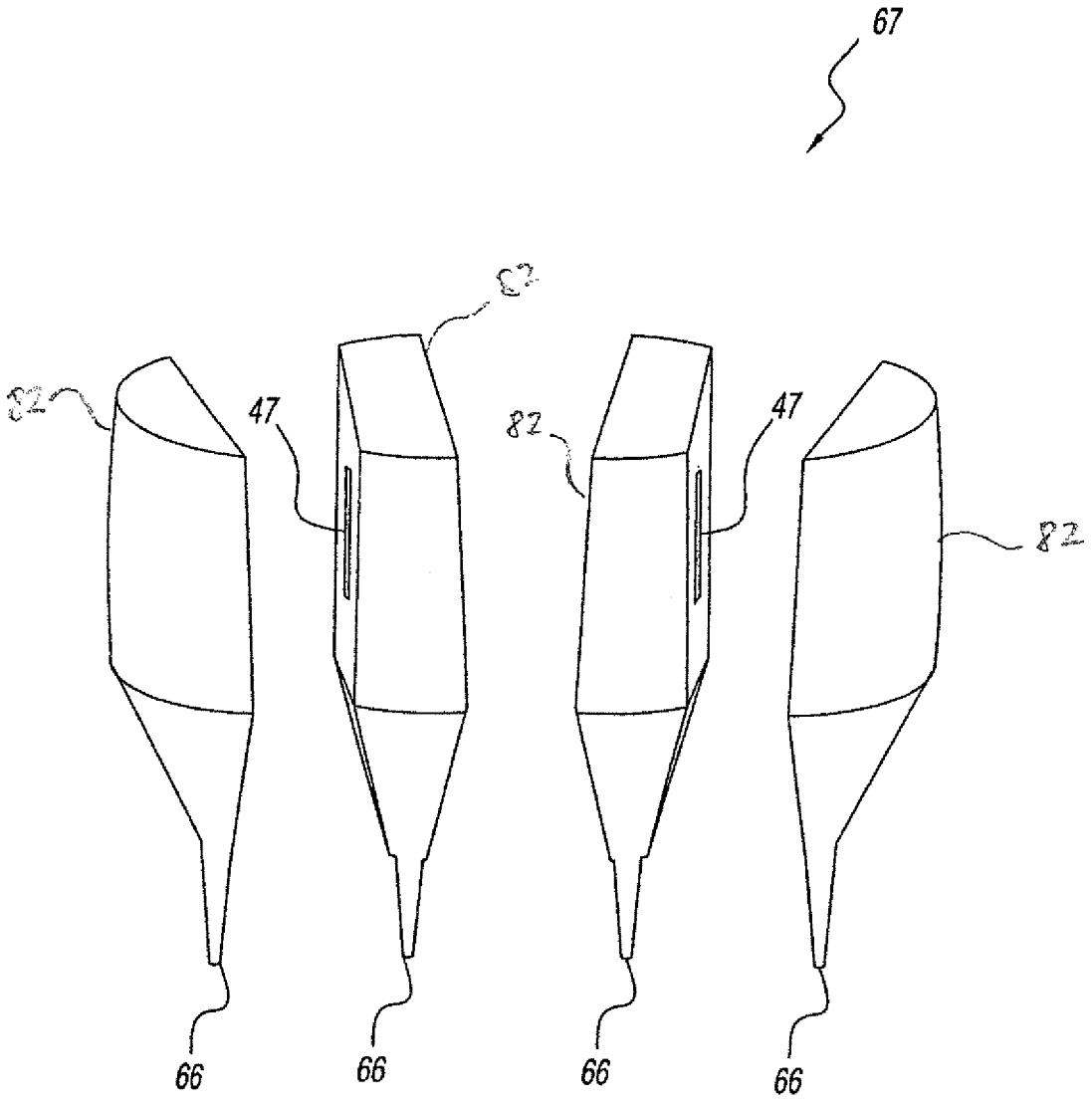
FIG. 28 is an exploded perspective view of a multi-color detachable hair color applicator according to the invention.

FIGS. 26 and 27 illustrate the use of self-adhesive paper 64 and multicolor nail polish applications. The self-adhesive paper 64 is useful for accurately aligning the colors applied to the fingernails via parallel cut 63 through the paper. It serves as a guide to apply straight lines, and other decorative shades to nails 65.

Figure 29:
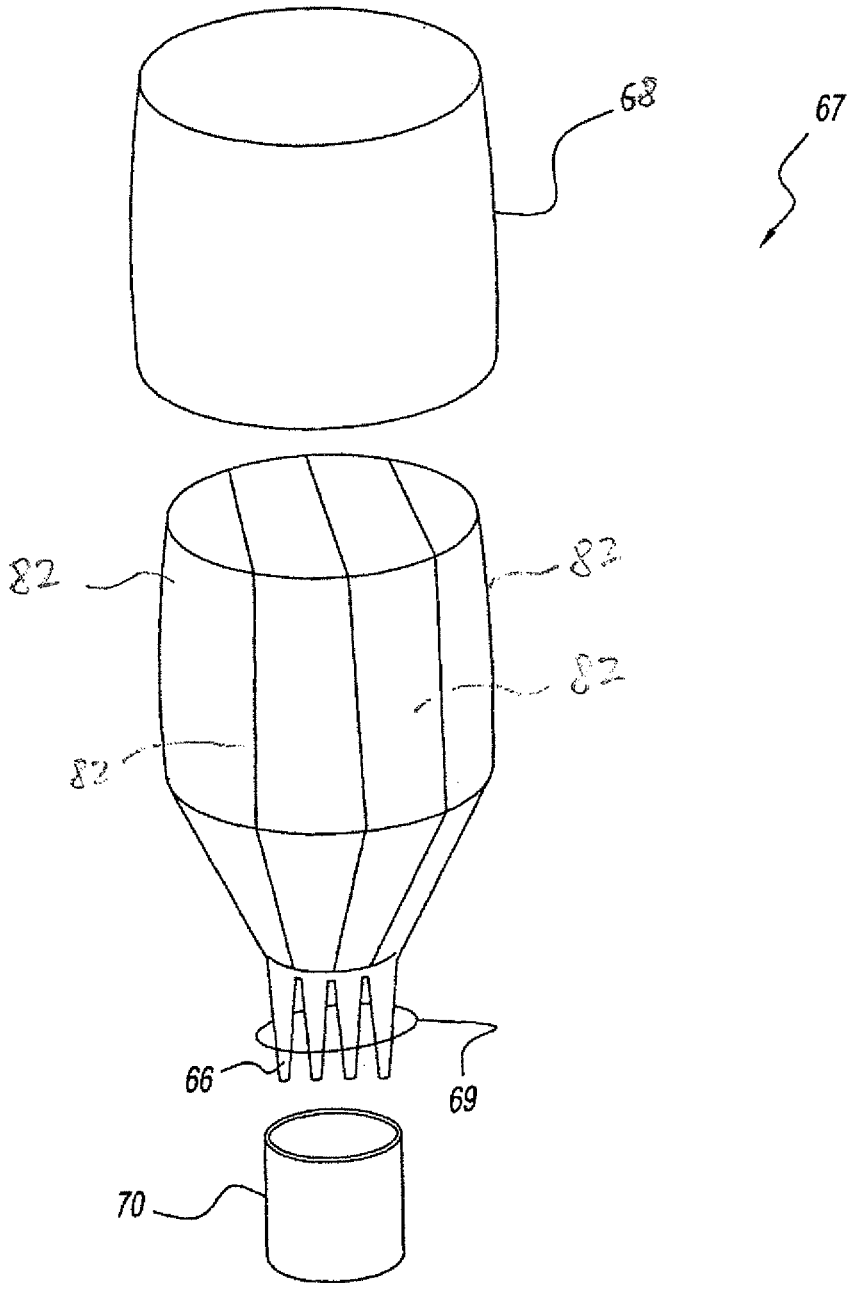
FIG. 29 is a perspective view of the multi-color detachable hair color applicator with the containers attached to each other.
Figure 30:
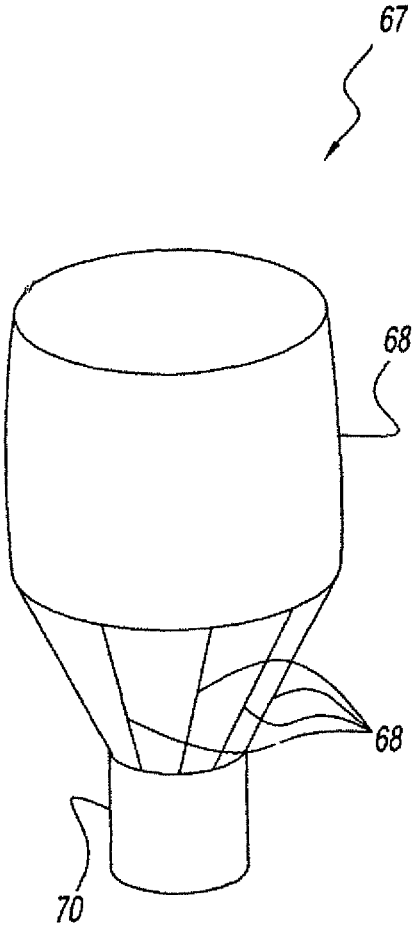
FIG. 30 is a fully assembled multi-color detachable hair color applicator.
Figure 31:
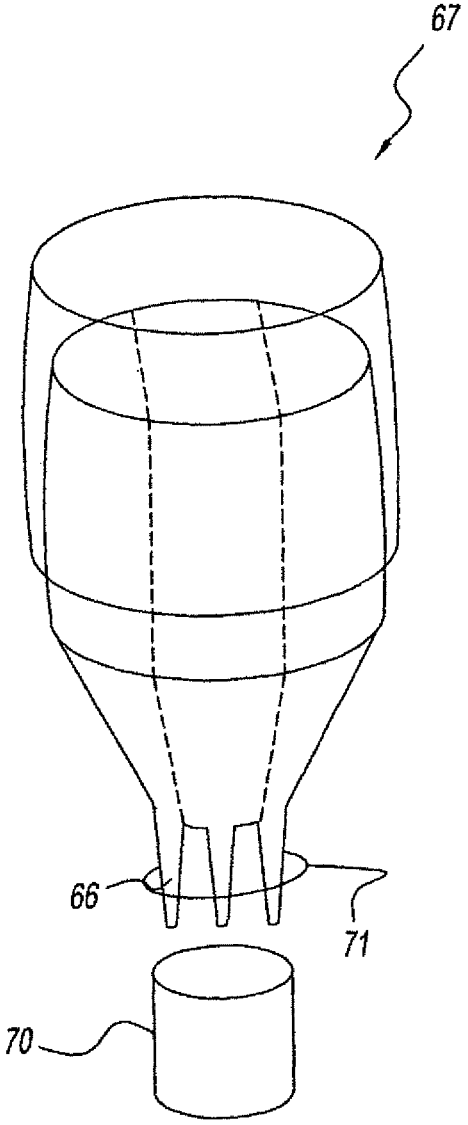
FIG. 31 is a three-nozzle partially assembled multi-color detachable hair dye applicator.

FIGS. 28 through 31 show an embodiment of an applicator 67 according to the invention for applying a multiplicity of hair colors to hair. In each case, the applicator 67 includes multiple tubes 82 containing respective hair dies of different colors. Each tube 82 has a nozzle 66 through which the hair dye in the tubes 66 can be squeezed. As shown in FIG. 29 the tubes 82 can be attached to each other to form a single bottle which can be received in a top lid 68, and the nozzles 66 can be closed by a bottom lid 70. The applicator functions in that the tubes 82 are removed from the top lid 68 and then the one of multiple colors that are desired to be applied to the hair are squeezed out of the respective tubes 82 so that each color is aligned with the hair. Thereafter, a brush is used to brush the color through the hair so that the hair winds up with multiple colors. The tubes 82 can be detachably attached to each other via a snap mechanism 47.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A cosmetic applicator, comprising:

a housing;

at least two applicator elements containing a cosmetic received in the housing;

a main mechanism; and at least two auxiliary mechanisms, said main mechanism and said at least two auxiliary mechanisms being connected to the at least two applicator elements, so that the at least two applicator elements are movable together out of and into the housing by actuating the main mechanism and are movable out of and into the housing independent of each other by actuating the at least two auxiliary mechanisms.

2. The cosmetic applicator of claim 1, wherein the at least two applicator elements comprise two lipsticks.

3. The cosmetic applicator of claim 1, wherein the at least two applicator elements comprise a lipstick and a lip liner.

4. The cosmetic applicator of claim 1, comprising at least three of said applicator elements and at least three auxiliary mechanisms, said at least three applicator elements comprising a lipstick, a lip liner and a lip gloss, each being individually movable in the housing by a respective one of the at least three auxiliary mechanisms, and movable together by the main mechanism.

* * * * *